US007832413B2

(12) United States Patent
Walters et al.

(10) Patent No.: US 7,832,413 B2
(45) **Date of Patent: *Nov. 16, 2010**

(54) THERAPEUTIC STYLING BRUSH WITH INFUSION DELIVERY

(75) Inventors: Megan Walters, Canton, OH (US); Michael Defenbaugh, Marietta, GA (US); Stan Chudzik, Alpharetta, GA (US); Joni Harrison, Atlanta, GA (US); Kelly Chapman, Atlanta, GA (US)

(73) Assignee: Goody Products, Inc., Atlanta, GA (US)

( * ) Notice: Subject to any disclaimer, the term of this patent is extended or adjusted under 35 U.S.C. 154(b) by 271 days.

This patent is subject to a terminal disclaimer.

(21) Appl. No.: 11/925,395

(22) Filed: Oct. 26, 2007

(65) Prior Publication Data

US 2008/0099031 A1 May 1, 2008

Related U.S. Application Data

(60) Provisional application No. 60/863,234, filed on Oct. 27, 2006.

(51) Int. Cl.
*A45D 24/16* (2006.01)
*A45D 24/22* (2006.01)

(52) U.S. Cl. ..... 132/108; 132/112; 132/120

(58) Field of Classification Search ..... 132/112–116, 132/120, 119, 108; 15/160, 104.94, 109.93, 15/206

See application file for complete search history.

(56) References Cited

U.S. PATENT DOCUMENTS

| | | | | |
|---|---|---|---|---|
| 912,719 | A | | 2/1909 | McMurran |
| 1,352,346 | A | | 9/1920 | Benson |
| 1,596,358 | A | | 8/1926 | Jones |
| 1,794,130 | A | * | 2/1931 | Whalen ..... 132/111 |
| 2,226,663 | A | | 12/1940 | Hill et al. |
| 2,547,834 | A | | 4/1951 | Perwas |
| 2,569,276 | A | | 9/1951 | Baptist |
| 2,594,721 | A | | 4/1952 | Beebe |
| 2,943,602 | A | | 7/1960 | Rundle |
| 4,118,823 | A | * | 10/1978 | Axelrod ..... 15/176.6 |
| 4,370,072 | A | | 1/1983 | Moffitt, Jr. |
| 4,585,018 | A | | 4/1986 | O'Conner |
| 4,826,340 | A | | 5/1989 | Rothweiler et al. |
| 4,834,076 | A | * | 5/1989 | Millet et al. ..... 601/154 |
| 5,325,878 | A | | 7/1994 | McKay |
| 5,338,124 | A | | 8/1994 | Spicer et al. |
| 5,483,719 | A | | 1/1996 | Ikemoto et al. |

(Continued)

FOREIGN PATENT DOCUMENTS

| | | | |
|---|---|---|---|
| EP | 890326 | A2 * | 1/1999 |
| WO | WO 9617536 | A1 * | 6/1996 |

OTHER PUBLICATIONS

Derwent 1989-350374, Tevina, Jul. 26, 1989.*
International Search Report and Written Opinion, mailed Apr. 24, 2008, for PCT/US07/82864; 11 pgs.

*Primary Examiner*—Robyn Doan
(74) *Attorney, Agent, or Firm*—Gardner Groff Greenwald & Villanueva, PC

(57) ABSTRACT

The present disclosure is generally directed to styling tools having a therapeutic agent distributed through the styling tool bristles or pad.

8 Claims, 8 Drawing Sheets

U.S. PATENT DOCUMENTS

| | | | | |
|---|---|---|---|---|
| 5,614,578 | A | 3/1997 | Dong et al. | |
| 5,758,984 | A | 6/1998 | Doherty | |
| 6,071,029 | A | 6/2000 | Weinstock | |
| 6,421,872 | B1 * | 7/2002 | Sciandivasci | 15/176.4 |
| 6,745,779 | B2 | 6/2004 | Piatetsky | |
| 6,962,456 | B2 | 11/2005 | Larsen | |
| 7,309,182 | B2 * | 12/2007 | McKay | 401/138 |
| 7,353,777 | B2 * | 4/2008 | Morosin et al. | 119/612 |
| 2002/0187176 | A1 | 12/2002 | Yao | |
| 2006/0086370 | A1 | 4/2006 | O'Meara | |
| 2006/0171981 | A1 | 8/2006 | Ricahard et al. | |

* cited by examiner

THERAPEUTIC STYLING BRUSH WITH INFUSION DELIVERY

RELATED APPLICATION

This application claims the benefit of U.S. Provisional Patent Application Ser. No. 60/863,234 under 35 USC §119 or 120, filed 27 Oct. 2006, the contents of which is incorporated by reference as if fully expressed fully herein.

FIELD OF THE DISCLOSURE

The present disclosure is generally directed to styling tools having a therapeutic agent distributed through the styling tool bristles or pad.

BACKGROUND OF THE DISCLOSURE

Use of brushes and/or combs to deliver therapeutic agents to the hair or skin (e.g., scalp) is generally well known in the art, as a means to treat a variety of conditions, including hair color fade, dry hair, dandruff, and the like. For example, Ikemoto et al., U.S. Pat. No. 5,483,719 discloses a brush having a replaceable rod that is placed into the head of the brush and allows delivery of a therapeutic agent to the hair, where the rod holds the therapeutic agent. However, such brushes allow for only one therapeutic agent to be delivered and the large rod is prone to having pieces break off into the user's hair. Furthermore, the design modifications necessary to protect the rod when not in use can catch in the user's hair and make the brush cumbersome to operate. These devices and others teach an additional component of the brush that releases the agent during use.

Accordingly, it can be seen that needs exist for improved delivery mechanisms for a therapeutic agent using a brush or comb without cumbersome additional components. It is to such solutions that the present invention is primarily directed.

SUMMARY OF THE INVENTION

The invention is directed to a styling tool having bristles embedded with or otherwise storing a therapeutic agent. In some embodiments, a brush comprises bristles having more than one therapeutic agent. In a specific embodiment, the same bristle has more than one therapeutic agent, while in a different specific embodiment, a brush has a first bristle having a first therapeutic agent and a second bristle having a second therapeutic agent, wherein the first and second therapeutic agents are different. In various embodiments, the brush or comb has removable and/or replaceable bristles embedded with a therapeutic agent.

In other embodiments, the invention is directed to a hair styling tool having a brush head with a pad; one or more bristles extending from the pad; and one or more therapeutic agents that may be embedded or infused in the pad. In a related embodiment the pad and bristles may form a replaceable unit. In still another embodiment, the brush pad's composition may be 90% TPE, 5% EVA, and 5% therapeutic agent.

In embodiments of the present invention, the therapeutic agent(s) may be jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and/or lecithin.

Figure 1:
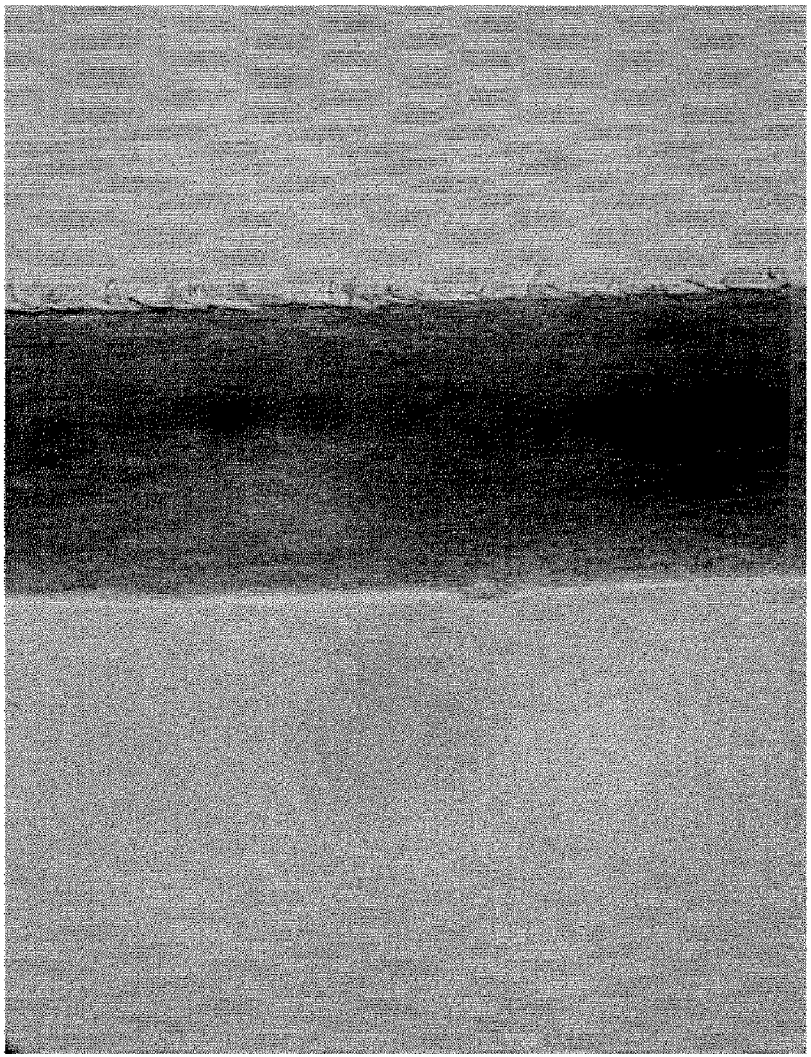
FIG. 1 is an image of a hair strand, showing the cuticle of the hair after a normal shampoo wash and blow dry.

While the method and device described herein are susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the disclosure.

DETAILED DESCRIPTION OF THE DISCLOSURE

Disclosed herein are styling tools having therapeutic agents embedded, infused, or otherwise stored on or in the bristles of the brush or teeth of the comb, the brush-head pad of a brush, or both, where the therapeutic agent is released or deposited into the hair when the hair is brushed.

As used herein, the term "therapeutic agent" means any agent capable of improving a condition of the hair and/or skin of the user. Nonlimiting examples of such agents include jojoba oil, tea tree oil, olive oil, carrot oil, ceramide, questamide, scented oils, ceramics, color protectants, antidandruff agents, antistatic agents, conditioning agents, agents that increase shine of the hair, carbon and/or other agents that decrease odor of the hair, silver flake, salicylic acid, copper oxide, and copper. Some or all of these agents may include ingredients that are heat activated, such as, for example, wax, powder, or other transitional state substances.

Conditioning agents that may be used typically fall within a group of several major categories: moisturizers, reconstructors, acidifiers, detanglers, thermal protectors, glossers, and oils, such as EFAs—essential fatty acids. Moisturizers can be concentrated with humectants or reconstructors. Humectants are compounds that attract and hold moisture into the hair. Reconstructors normally contain protein. Hydrolyzed human hair keratin protein is a preferred source of protein because it contains all 19 amino acids found in the hair. Human hair keratin protein also has a low molecular weight, which enables it to penetrate the hair shaft (the cortex). A reconstructor is often used to strengthen the hair. Nonlimiting examples of reconstructors include behentrimonium methosulfate, cetearyl alcohol, lactamide MEA, wheat amino acids, burdock root citrus bioflavinoids, meadowfoam oil, stearalkonium chloride, and lecithin.

Acidifiers may be used to create shine and add elasticity without weighing down the hair, making acidifiers important for people with fine-textured hair. Hair is elastic because of hydrogen bonds (H-bonds), which are electromagnetic bonds and may be broken by nearly any aqueous substance or compound. Hydrogen bonds are also affected by pH and electrolytes. Water breaks H-bonds and causes them to be in a "beta" state (point of greatest weakness); H-bonds devoid of most moisture arrive at an "alpha" state (point of greatest strength). Acidic solutions also add a positive electron to the bonds, creating elasticity. Electrolytic solutions such as potassium, magnesium, sodium, and many others add a positive electron to the H-bond that creates this elasticity. Behentrimonium Methosufate, Cetearyl Alcohol, Lactimide MEA, Panthenol, Wheat Amino Acids, Burdock Root, Citrus Bioflavinoids, Meadowfoam Oil, Stearealkonium Chloride, Lecithin, are possible ingredients for Acidifiers.

Detanglers are typically acidifiers with a low pH of about 2.5 to about 3.5. They close the cuticle of the hair, which prevents tangles. Wheat protein, botanicals, and lipids are examples of detanglers. Some detanglers "shield" the hair shaft with polymers. Most detanglers are categorized as acidifiers due to their lower pH value but may also contain polymers that prevent individual hairs from tangling up with one another. Additives such as silicone and propylene glycol allow the hair to avoid tangling. Some detanglers are instant, while others may need about 1-5 minutes to be effective.

Thermal protectors safeguard the hair against heat. Use of thermal protectors is of particular importance in instances where hair is exposed to heat from hairdryers, curling irons, flat irons, hot rollers or similar techniques. Thermal protectors are normally heat absorbent polymers that distribute heat to minimize heat damage to hair. Nonlimiting examples of thermal protectors include PVP/VA copolymer, dimethicone copolyol, cyclomethicone, polysorbate-20, chamomile extract, and birch bark extract.

Glossers typically contain dimethicone or cyclomethicone. Used in small amounts, glossers reflect light and/or can control "frizzies." A nonlimiting example of a glosser includes oils (EFAs), as they are similar in nature to the scalp's sebum (natural oil secretion of the scalp), and sebum contains EFAs. Dry hair, especially dry hair due to chemical treatment of the hair, e.g., hair color, perms, and relaxers, typically is lacking in natural oils or sebum. EFAs can transform very dry and porous hair into soft pliable hair. Vanilla bean is an example of this conditioner type.

The amount of therapeutic agent embedded in the bristles is selected based on the type of agent, the desired end use, expected useful life, expected time from manufacture to sale, and the like. Typically, the therapeutic agent or agents are mixed into a resin before injection molding of the bristles, with the amount of therapeutic agent ranging from about 0.5% to about 20% by weight of the total composition (including the resin) that the bristles are made of. In some embodiments, the amount of therapeutic agent is about 0.5% to about 5% by weight of the total composition, and preferably about 1% to about 2%. In embodiments where more than one therapeutic agent is embedded in a single bristle, the total amount of all the therapeutic agents is preferably less than about 20% by weight of the total composition, but each individual therapeutic agent can be about 0.5% to about 15%, preferably about 0.5% to about 5%. In a specific embodiment in which jojoba oil is used, the bristles and/or pad material base stock preferably has a composition of 90% TPE, 5% EVA, and 5% jojoba oil. In another embodiment, the composition may be 85% PE, 10% EVA, and 5% jojoba oil. And in still another embodiment, the composition may be 85% PE, 5% EVA, and 5% jojoba oil, with the remaining 5% being a filler material.

The therapeutic agents of the present invention may be embedded into the bristle of the brushes by mixing with the appropriate resin prior to molding of the bristle. Appropriate resin composition choice is within the knowledge of one of skill in the art and will depend upon the end use of the bristle and/or brush and their desired properties, such as heat resistance, brittleness, and the like. Bristles chosen from animals (boar, sable, goat, etc.) may also be treated with these therapeutic agents.

Typical bristles can be made of one or more polymers, such as polyethylene (PE), Linear Low Density Polyethylene (LLDPE) & Low Density Polyethylene (LDPE), High Density Polyethylene (HDPE), polypropylene, polycarbonate, styrenes (HIPS—High impact polystyrene), Styrene-Acrylonitrile (SAN), polyurethane rubber (PU), polyacetates, polyesters, polyamides, polyolefins, fluoropolymers, polyvinylchloride, polyurethane, polyvinylidene chloride, Acrylonitrile-Butadiene-styrene (ABS), Kostrate, Propionate, Nylon, Thermoplastic Elastomer (TPE), Cholorprene (CR), Acrylate-Butadiene (ABR), Isoprene (IR), Natural Rubber (PBR), Thermoplastic Vulcanizate (TPV—Santoprene), mixtures thereof, and the like. Typically, the amount of polymer forming the bristle is about 80 to about 98% by weight of total composition. Alternatively, natural bristles produced from animal hair such as boar, squirrel, horse, pony, goat, and sable can be treated with these additives through spraying or dipping the desired additive.

The bristle may further include a softening agent (alternatively called a plasticizer). Typically, the softening agent may be about 1% to about 5% of the total composition. Ethylene vinyl Acetate (EVA), Ethylene-Propylene Copolymer (EPM), Chloroprene (CR-Neoprene), Nitrile-butadiene (NBR), Nitrile-Chloroprene (NCR), Silicone (MQ, PMQ, VMQ, PVMQ), Styrene-Butadiene (SBR), Styrene-Chloroprene (SCR), Styrene-Isoprene (SIR), Pyridine-Butadiene (PBR), Pyridine-Styrene-Butadiene (PSBR) are all possible polymer additives that may "soften" the properties of the resins listed previously. Plasticizers such as Dioctyl Phthalate, Butyl Benzyl phthalate, Butyl Cycloheyxl phthalate, Butyl Decyl phthalate, Butyl Octyl phthalate, Diphenyl phthalate, Cresyl Diphenyl phosphate, Methyl Phthaly ethyl glycollate, Chlorinated biphenyls, Chlorinated Paraffins, Didecyl Adipate, Dioctyl Adipate, Dioctyl Azelate, Dioctyl Sebacate may also be used to soften the polymer.

The bristles may be made in any manner now known or later developed. Typically, the bristle is made using an injection mold process or extrusion process. The bristles may be fabricated such that individual rows may be replaced on a brush head, the entire brush head may be replaced, the brush pad may be replaced on the brush head, and/or individual bristles may be replaced. This design may allow for individualized brushes dependent upon the user's desired purpose. For example, a user may wish to use a brush which may deliver a conditioning agent as well as an antidandruff agent. Bristles having a conditioning agent and bristles having an antidandruff agent may be placed in the brush. Additionally and alternatively, these removable bristles may be used in the event a therapeutic agent is diminished. Replacement bristles may be placed in the brush head, giving the user a brush having a usable amount of therapeutic agent.

Contemplated specific embodiments for brushes according to the present invention include, but are not limited to, the following:

1) a brush having bristles and/or a pad embedded with at least one therapeutic agent;

2) a brush having alternating or intermingled bristles with different therapeutic agents via:
   a) different bristles within the same tuft;
   b) intermingled tufts;
   c) alternating rows of bristles; and 3) a brush with one or more replaceable pads placed in the brush head; and 4) a brush with replaceable bristles (e.g., all bristles replaced at one time; individual rows replaced individually; and/or individual bristles or tufts replaced).

Referring to FIGS. 5A-5G, in an embodiment in which the pad is replaceable, the pad and bristles may be a single injection-molded component (the bristle/pad unit) molded in the desired resin. One desired resin may be of a 90% TPE, 5% EVA, with 5% Jojoba oil additive composition. The pad can be inserted into the brush head in various design and installation methods. One example design is depicted. The depicted brush 10 includes a handle 20 and a brush head 30 with a pad 35 of integral bristles 40 (the bristle/pad unit 38). The bristle/pad unit 38 is removably mounted to brush head 30 with the bristle/pad unit held securely in place for use and easily removable for replacement, as desired. In the depicted embodiment, for example, the brush head 30 includes a displaceable member such as a hinged cap 60, and the brush head and the hinged cap include retaining elements such as lip surfaces 80. When the cap 60 is in a closed position (see FIGS. 5A and 5F), the lip surfaces 80 engage the peripheral edges of the pad 35 to secure the bristle/pad unit 38 to the brush head 30 while the bristles 40 extend through the central opening defined by the lip surfaces. In addition, the brush head 30 preferably has one or more support surfaces 84 that cooperate with the retaining lip surfaces 80 to define a channel 86 that receives the peripheral edges of the pad 35 with a snug fit, thereby helping to secure the bristle/pad unit 38 in place. The cap 60 and the brush head 30 have mating couplings such as snap-fit elements for releasably securing the cap in the closed position. Also, the cap 60 can be hinged relative to the brush head 30 by providing the cap hinged to a base 62 and the base attached to the brush head, with the base and the cap an integral piece of resilient material such as plastic. In any case, when the cap 60 is swung to an open position (see FIGS. 5B and 5G), the lip surface 82 of the cap no longer engages the adjacent peripheral edge of the pad 35, so the bristle/pad unit 38 can be grasped and pulled out of engagement with the lip surfaces of the brush head 30 (see FIGS. 5C-5E). A fresh bristle/pad unit 38 can then be inserted, with its peripheral edges inserted into the channel 86, and the cap 60 can be returned to the closed position, so that the brush 10 is ready for further use.

In alternative embodiments, the displaceable member is a cap, panel, pin, tab, or other member that engages and retains the pad in place in the closed position, and that slides, unscrews, pivots, or is otherwise displaceable up, out, or laterally to an open position out of retaining engagement with the bristle/pad unit. In other alternative embodiments, the cap and the brush head mating couplings are provided by mating threads, detents, a bayonet fitting, or other conventional couplings for releasably securing the cap in the closed position. In still other alternative embodiments, the retaining elements of the brush head and displaceable member are provided by non-continuous lips (i.e., a scalloped edge), tabs, spring-biased elements, or other conventional retaining elements adapted for holding the pad on the brush head. And in yet other alternative embodiments, the cap is hinged relative to the brush head by a pin or other conventional hinging structure.

Figures 5A, 5B, 5C, 5D, 5E:
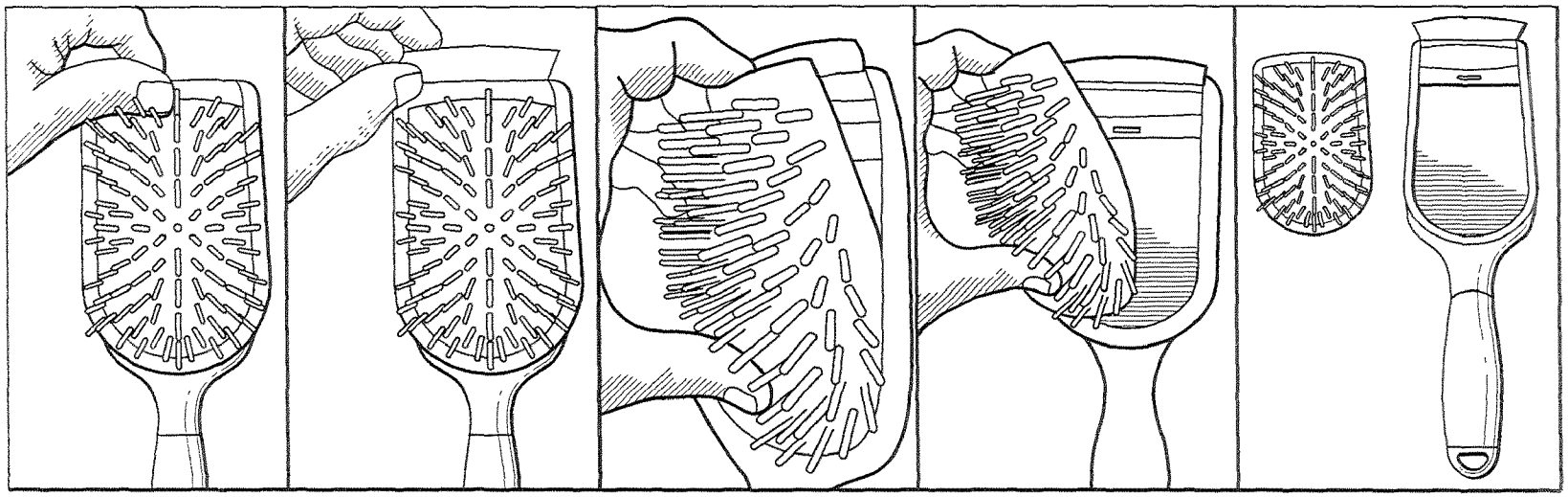
FIGS. 5A-5E are plan views of a brush with a replaceable pad according to one embodiment of the present invention, showing the process of displacing a retainer cap and removing the replaceable brush head pad.
Figure 5G:
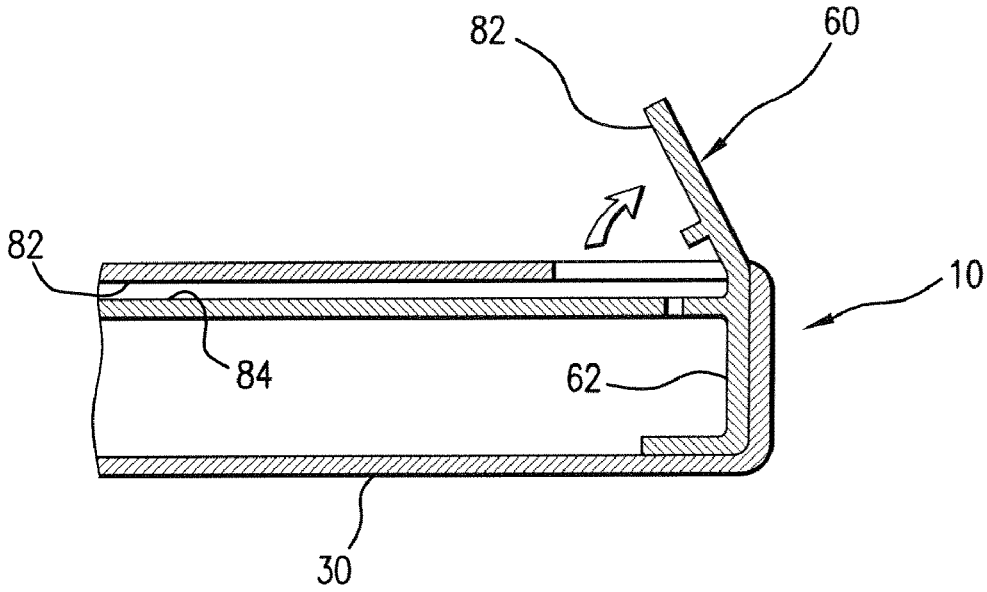
FIG. 5G is a longitudinal cross section view of the top end of the brush head in the position shown in FIG. 5E.
Figure 5F:
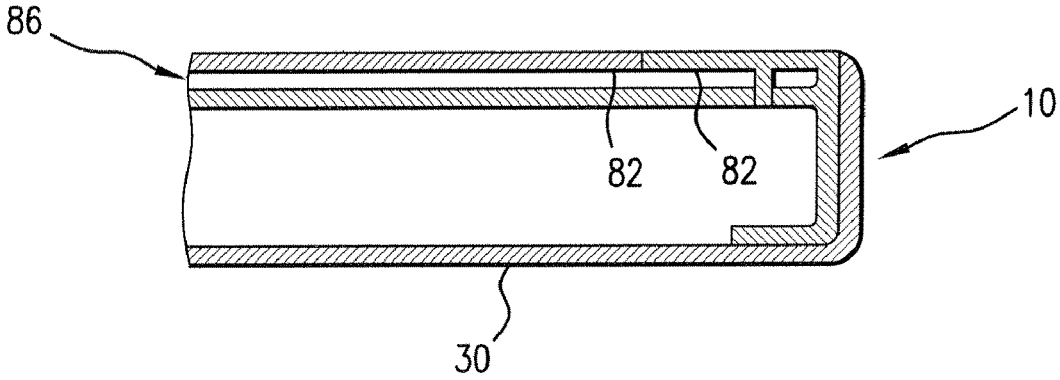
FIG. 5F is a longitudinal cross section view of the top end of the brush head, without the pad, in the position shown in FIG. 5A.

In addition, one method of installation is snapping open a "cap" on the top of the brush head exposing the top of the bristle pad as shown in FIGS. 5A and 5B. The pad can then be removed by sliding it out of the grooves of the brush head as shown in FIGS. 5C and 5D. Reversing the operation, to reinstall the pad, the bristle pad perimeter edge is inserted into the molded grooves of the brush head and then the top "cap" may closed to secure the bristled pad in the brush head as shown in FIG. 5E.

Figure 6:
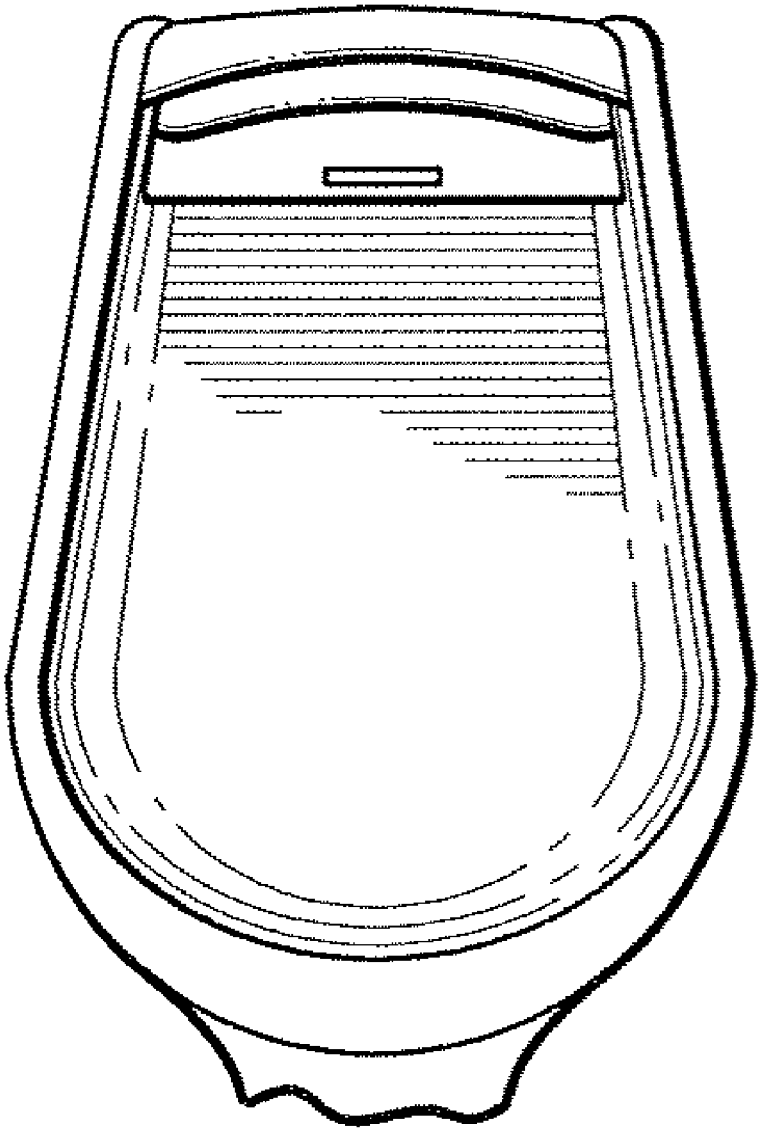
FIG. 6 is a plan view of a brush according to another embodiment of the present invention showing a styling tool with a replaceable pad, in which the cap of the tool does not open for pad replacement.

Referring to FIG. 6, in another embodiment the cap is fixed in place and not displaceable, so the retaining lip surfaces of the cap are not displaceable from retaining engagement with the bristle/pad unit. However, the pad is fabricated of materials having sufficient elasticity that the pad can be grasped, deformed from its neutral shape, and pulled from the brush head.

In another embodiment the method of installation of the brush head may comprise inserting the bristled pad into grooves or channels of the brush head. This assembly may be used for brush head/bristle pad assemblies for any brush head design, such as, for example, square, oval, or rectangular. In this embodiment, as shown in FIG. 6, the top cap does not open.

Figure 7:
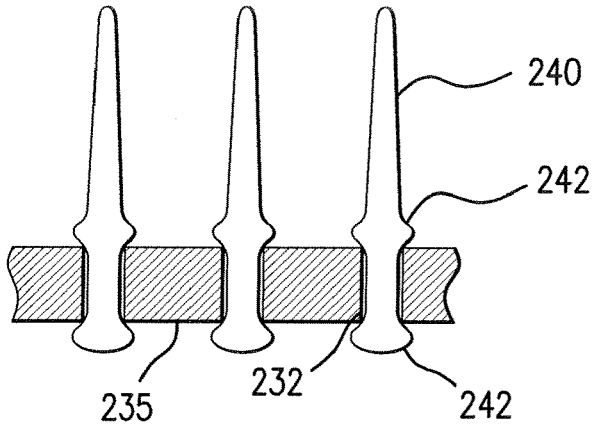
FIG. 7 is a side view of a portion of a brush head according to another embodiment of the present invention, showing individual bristles removably attached to the pad.
Figure 8:
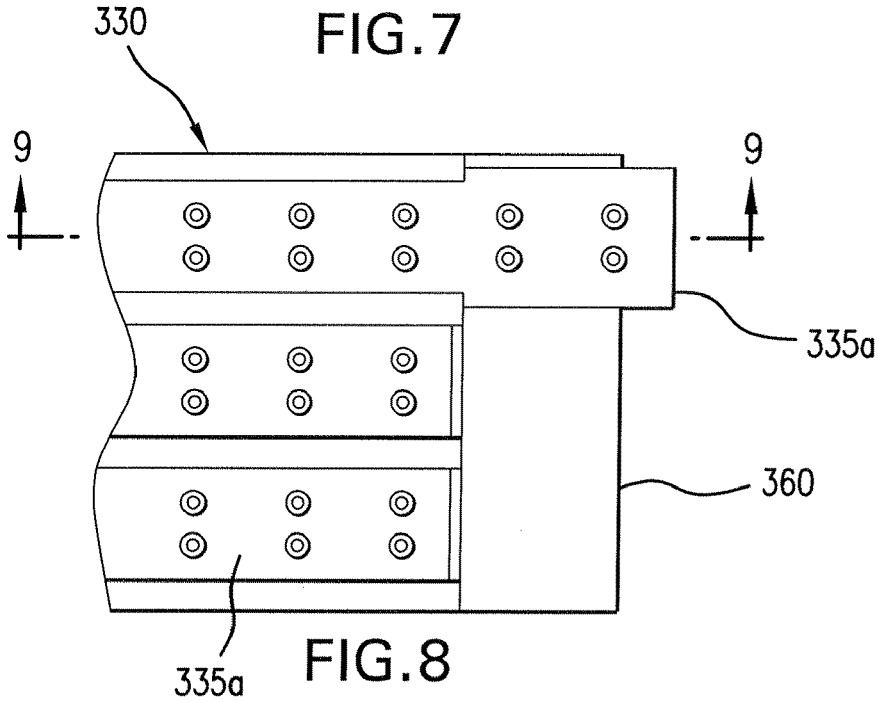
FIG. 8 is a top view of a portion of a brush head according to another embodiment of the present invention, showing bristle pad sections removably mounted to the brush head.
Figure 9:
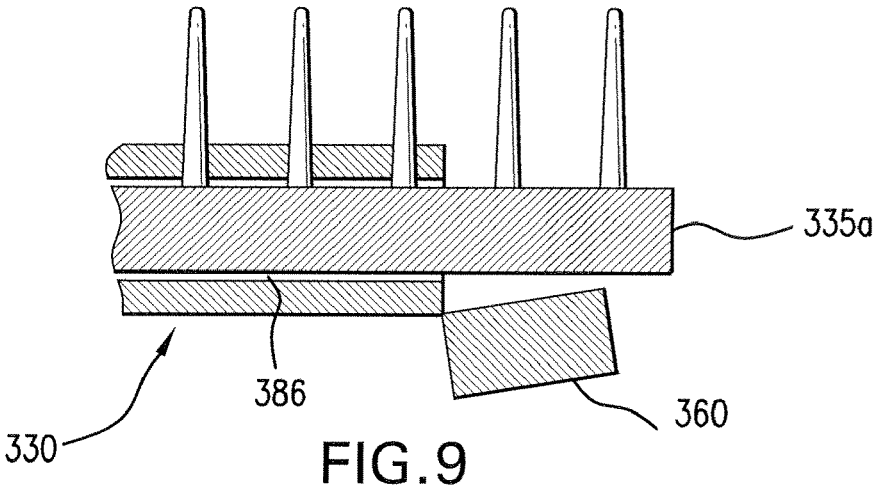
FIG. 9 is a cross section view of the brush head of FIG. 8 taken at line 9-9.

Referring to FIGS. 7-9, in other embodiments individual bristles are replaceable or rows or other sections of bristles are replaceable. In the embodiment of FIG. 7, for example, the brush pad 235 has apertures 232 that receive the bristles 240 and the bristles have protrusions 242 that removably retain them in the apertures with a snap fit so that the bristles can be individually removed and replaced. In alternative embodiments, the bristles and the brush pad include mating threads, spring-biased retainers, or other conventional couplings for removably attaching each individual bristle to the brush pad.

And in the embodiment of FIGS. 8-9, for example, the brush head 330 has a plurality of channels 386 that each receive one bristle/pad section 335*a*, the channels extend through the end of the brush head, and the brush head includes a displaceable member such as a hinged cap 360 that is displaceable to the position shown in the figures so that individual bristle/pad sections can be removed and replaced as needed. In alternative embodiments, the individual bristle/pad sections and the brush head include mating threads, snap-fit structures, spring-biased retainers, or other conventional couplings for removably attaching rows or other sections of bristles to the brush head.

In further embodiments, the brush includes a replaceable pad/bristle unit that is not treated with therapeutic agents, but that still can be easily removed and replaced with a different pad/bristle unit. For example, the brush head can accept any of a variety of different pad/bristle units, each specifically designed for and dedicated to specific styling technique, hair type, etc. In alternative embodiments, the pad/bristle units can be treated with a substance other than the therapeutic agents disclosed herein.

The bristle density can be manipulated in brushes disclosed herein. In some embodiments, the therapeutic agent may increase the brittleness of the bristle or in some way alter the structural integrity of the bristle. In such cases, these effects may be mitigated by increasing the number of bristles on the head of the brush, thereby increasing the bristle density. This determination is within the knowledge of one of skill in the relevant art and can be easily ascertained.

EXAMPLES

Figure 2:
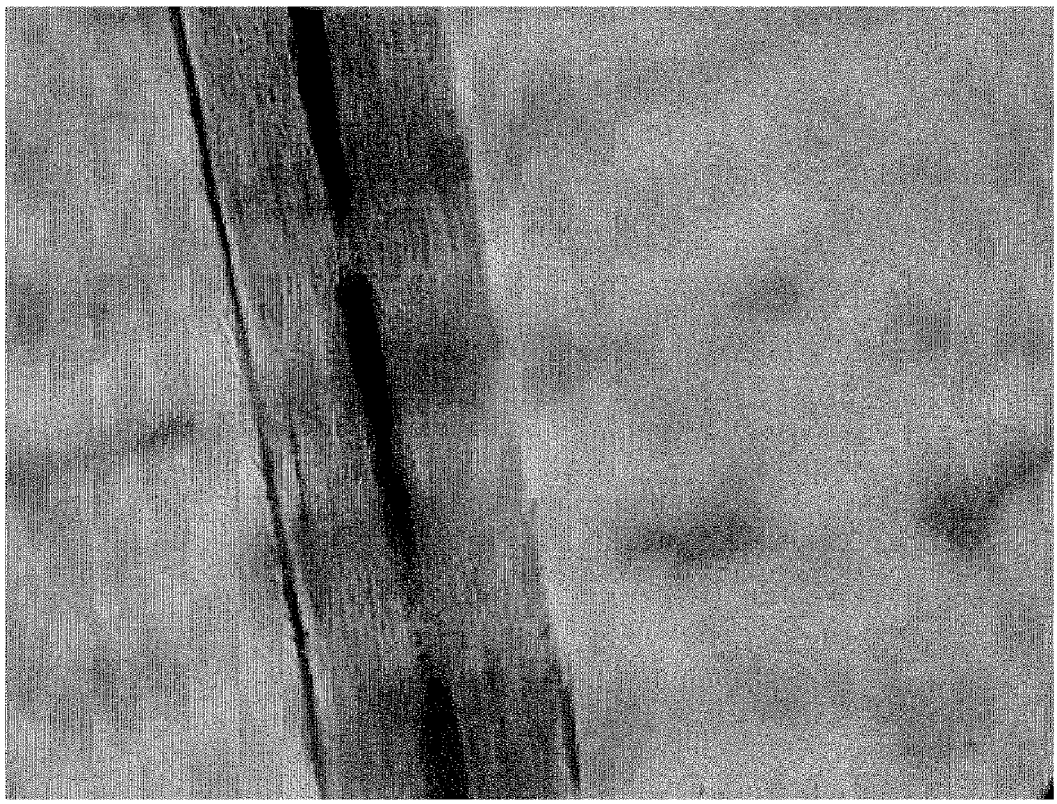
FIG. 2 is an image of a hair strand, showing the cuticle of the hair after 100 brush strokes using a standard rubber brush pad.

A standard rubber brush pad was used as a control to compare brushes having bristles as described herein. In a control experiment, test hair was shampooed and dried using a hair dryer. The resulting hair was then examined under a microscope at 400× magnification. As seen in FIG. 1, the cuticle of the hair is pronounced. The hair was then brushed with 100 strokes using a standard rubber brush pad. FIG. 2 shows that the cuticle of the hair is still noticeable.

Figure 3:
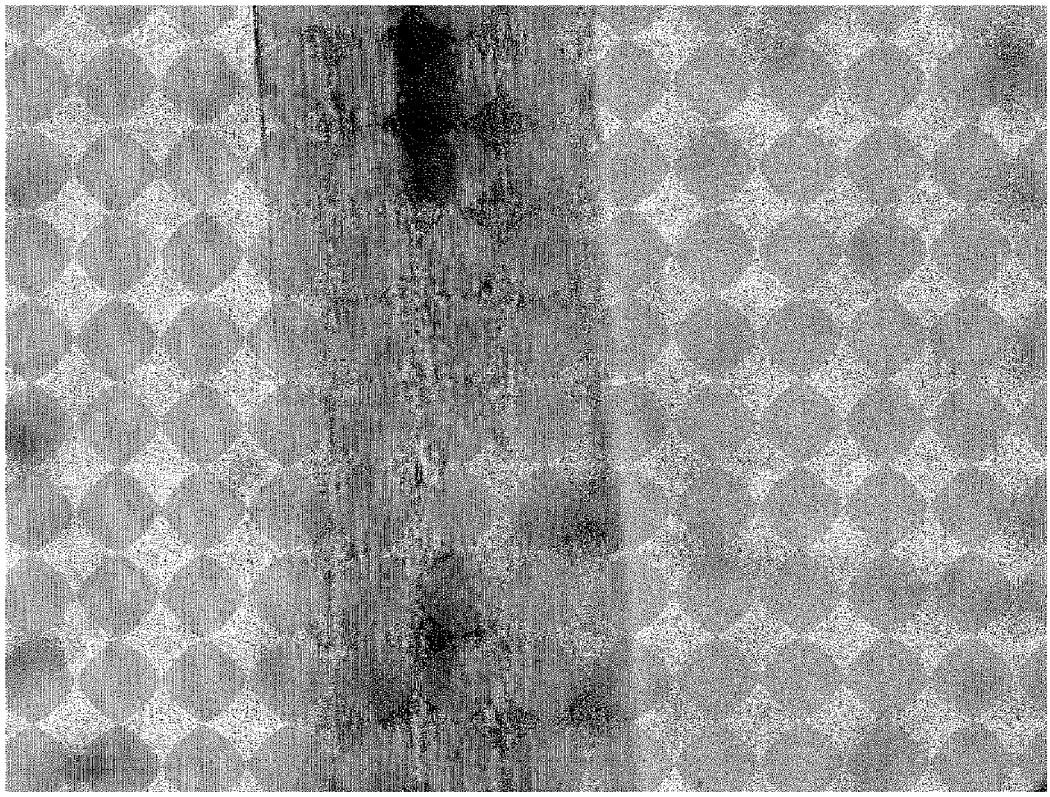
FIG. 3 is an image of a hair strand, showing the cuticle of the hair after 100 brush strokes using a rubber brush pad having ceramide infused bristles.

In one test, a brush having bristles embedded with ceramide was used on test hair that had been shampooed and dried using a hair dryer. The hair was then brushed with the ceramide infused bristle brush for 100 strokes and then examined under a microscope at 400× magnification. The resulting hair is shown in FIG. 3. The cuticle of the ceramide-bristle treated hair was much less noticeable than that of the control hair (FIG. 2).

Figure 4:
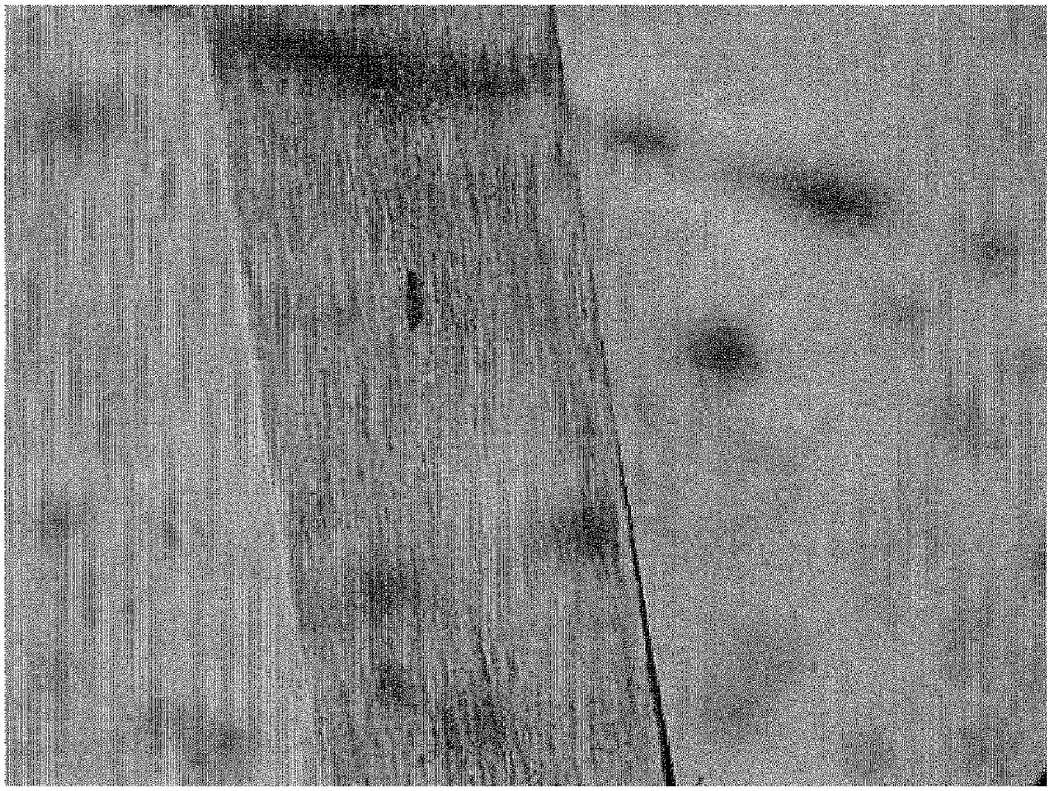
FIG. 4 is an image of a hair strand, showing the cuticle of the hair after 100 brush strokes using a rubber brush pad having jojoba oil infused bristles.

A second test was performed with a brush having jojoba oil infused bristles. After shampooing and drying, the hair was brushed with 100 strokes and examined under a microscope at 400× magnification. As seen in FIG. 4, the cuticle is not noticeable after brushing with the jojoba oil infused bristle brush.

While the present invention has been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention.

We claim:

1. A hair styling tool, comprising:

a brush head including a pad that is replaceable on said brush head and that is made a polymer material;

one or more rows of bristles extending from said pad and made of a polymer material, wherein said pad and said bristles form a replaceable unit; and one or more therapeutic agents, wherein said agent is embedded in or stored behind said pad, embedded in said bristles, and distributed to a user's hair through said bristles and said pad, wherein said therapeutic agent is two or more materials selected from the group comprising jojoba oil, carrot oil, tea tree oil, olive oil, ceramide, questamide, scented oil, ceramics, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin, wherein said pad and said bristles are molded of a resin comprising about 80% to about 98% by weight of at least one polymer, about 1% to about 5% by weight of at least one softening agent, and about 0.05% to about 20% by weight of said therapeutic agent, wherein said polymer pad, said bristles, or both dispense said therapeutic agent by capillary action.

2. The tool of claim 1, wherein said brush head includes a displaceable member and said brush head and said displaceable member include pad-retaining elements, wherein the displaceable member is displaceable from a first position in which the pad-retaining elements engage the pad/bristle unit to retain it on the brush head to a second position in which the displaceable member pad-retaining elements do not retain the pad/bristle unit on the brush head so that the pad/bristle unit can be replaced.

3. The tool of claim 1, wherein said pad, said bristles, or both are molded of a composition comprising about 85% to about 90% by weight of TPE or PE, about 5% to about 10% by weight of EVA, and about 5% by weight of said therapeutic agent.

4. A hair styling tool comprising:

a brush head including a pad;

one or more rows of bristles extending from the pad; and at least one therapeutic agent that is embedded in or stored behind the pad, embedded in the bristles, and distributed to a user's hair through the bristles and the pad, wherein the pad and the bristles form a replaceable unit, wherein the brush head includes a closed backwall, a front with a central opening, and a displaceable endcap, wherein the brush head and the displaceable endcap include pad-retaining elements, wherein the displaceable endcap is displaceable from a first position to a second position, wherein in the first position the pad-retaining elements engage the pad but not the bristles to retain the pad/bristle unit on the brush head without clamping on the bristles, and in the second position the displaceable endcap pad-retaining elements do not retain the pad/bristle unit on the brush head so that the pad/bristle unit can be removed from and replaced on the brush head, and wherein said therapeutic agent is two or more materials selected from the group comprising jojoba oil, carrot oil, tea tree oil, olive oil, ceramide, questamide, scented oil, carbon, silver flake, salicylic acid, behentrimonium methosulfate, cetearyl alcohol, lactamide MEA, wheat amino acids, burdock root citrus bioflavinoids, meadowfoam oil, stearalkonium chloride, PVP/VA copolymer, dimethicone copolyol, cyclomethicone, polysorbate-20, chamomile extract, and birch bark extract, copper, copper oxide and lecithin, wherein said pad and said bristles are molded of a resin comprising about 80% to about 98% by weight of at least one polymer, about 1% to about 5% by weight of at least one softening agent, and about 05% to about 20% by weight of said therapeutic agent, wherein said polymer pad, said bristles, or both dispense said therapeutic agent by capillary action.

5. The tool of claim 4, wherein the pad-retaining elements include lips on the front surface that define the central opening, wherein the brush head further includes support surfaces that cooperate with the pad-retaining lips to define a channel that receives and retains the pad/bristle unit within the central opening spaced apart from the backwall.

6. The tool of claim 5, wherein two opposing ones of the cap-retaining lips are curved.

7. The tool of claim 4, wherein the displaceable endcap pivots between the first and second positions without being separated from the rest of the brush head.

8. The tool of claim 4, wherein said pad is molded of a composition comprising about 85% to about 90% by weight of TPE or PE, about 5% to about 10% by weight of EVA, and about 5% weight of said therapeutic agent.

* * * * *